US005567070A

United States Patent [19]

Ficcadenti

[11] Patent Number: 5,567,070

[45] Date of Patent: Oct. 22, 1996

[54] CONTAINER WITH APPLICATOR OF NAIL-VARNISH INTERPOSED BETWEEN FINGERS

[75] Inventor: Maurizio Ficcadenti, Grottammare, Italy

[73] Assignee: Inovo di Ficcadenti Maurizio & C. Snc., Grottammare, Italy

[21] Appl. No.: 419,053

[22] Filed: Apr. 7, 1995

[30] Foreign Application Priority Data

Apr. 12, 1994 [IT] Italy ..... TO94A0269

[51] Int. Cl.[6] ..... A45D 34/00

[52] U.S. Cl. ..... 401/7; 401/48; 401/129; 132/73

[58] Field of Search ..... 401/129, 8, 48, 401/7; 132/73

[56] References Cited

U.S. PATENT DOCUMENTS 2,140,231 12/1938 Jefferis ..... 401/129 X 2,656,842 10/1953 Ammarell .

2,865,384 12/1958 Noon .

FOREIGN PATENT DOCUMENTS 0026667 4/1981 European Pat. Off. .

*Primary Examiner*—Steven A. Bratlie

*Attorney, Agent, or Firm*—Watson, Cole, Stevens, Davis, P.L.L.C.

[57] ABSTRACT

A container with applicator for nail-varnish is provided which can be held interposed between fingers. The container includes a tank (1) provided with a plug (2) having an axial brush (3) for drawing from the tank and applying the varnish to the nails. The tank (1) has a pair of opposite deep recesses (4) of curved shape, each having such a dimension as to house a finger of the user's hand in order to keep the two fingers spaced apart during the application of nail-varnish.

20 Claims, 4 Drawing Sheets

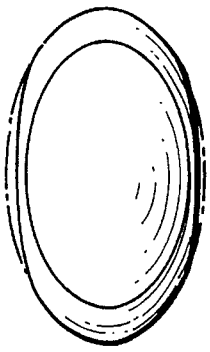
FIG. 12
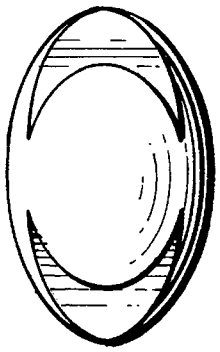
FIG. 13
FIG. 14
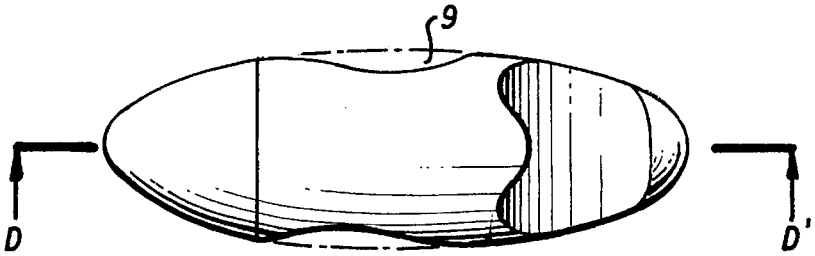
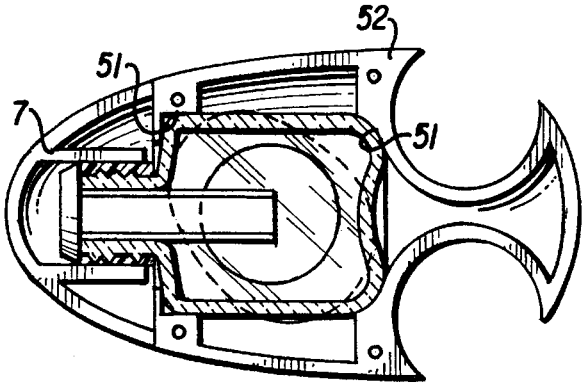
FIG. 15
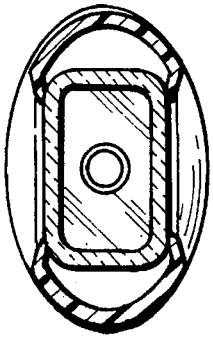
FIG. 16
FIG. 17
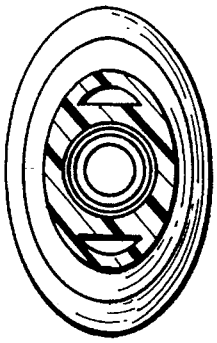

CONTAINER WITH APPLICATOR OF NAIL-VARNISH INTERPOSED BETWEEN FINGERS

FIELD OF THE INVENTION

The present invention relates to a portable container of nail-varnish which is characterized by the following features: it is put between two fingers of the hand so as to keep them apart; and it is provided with an applicator forming the closure/opening member of the container.

BACKGROUND OF THE INVENTION

The hitherto known containers of nail-varnish have the drawback that they cannot be used without a steady support plane. This invention overcomes such problem by providing a container which can be steadily held between two fingers of the user's hand.

SUMMARY OF THE INVENTION

In one preferred embodiment of the invention, the body of the container consists of three main portions: one portion is put between two fingers of the hand and includes the container; a second portion is the closure/opening member of the container; and a third portion is the brush acting as varnish applicator.

Besides allowing it to be put between two fingers of the user's hand, the form of the container is such as to prevent the nail-varnish from flowing outside the container. The containment of nail varnish enable by a guard surrounding the spout of the container. In a second preferred embodiment the container is divided into two halves housing a transparent small bottle of nail-varnish and having each a side opening which allows the colour of the nail-varnish to be seen from the outside. Further in this embodiment the two halves can be advantageously connected so that they can be taken apart to replace the bottle.

BRIEF DESCRIPTION OF THE DRAWINGS

For a better explanation this invention will now be described by way of an illustrative, non-limiting example with reference to the accompanying drawings, in which:

FIGS. 11 to 14 show a plan view, a front view, a rear view and a side view of a second embodiment of the container of nail-varnish according to the invention, respectively;

FIG. 15 shows a section of the tank of FIG. 14 along line D—D';

FIG. 16 shows a section of the tank of FIG. 11 according to line B—B';

FIG. 17 shows a section of the tank of FIG. 11 along line A—A';

DETAILED DESCRIPTION OF THE INVENTION

With reference to the above Figures, the container of nail-varnish includes a tank 1 having an elongated, preferably elliptical, cross section, as shown in FIGS. 2, 3, 6 and 7.

Such tank is provided with a plug 2 having an axial brush 3 by which the nail-varnish is drawn from the tank 1 and applied to the nails.

Figure 1:
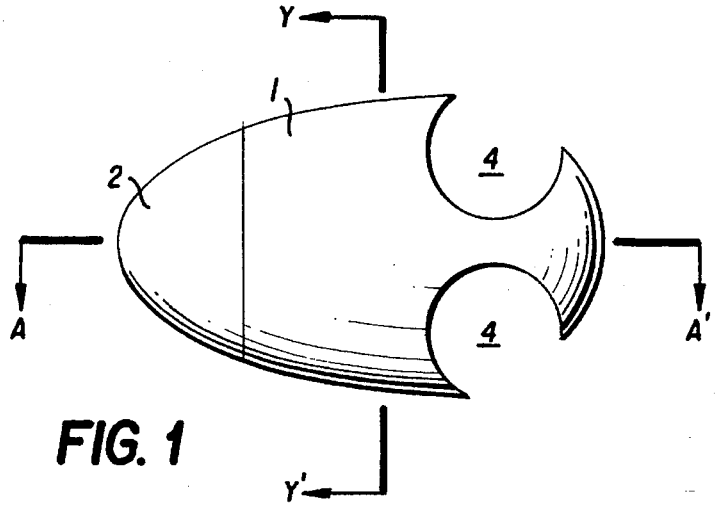
FIG. 1 is a plan view of the container according to the invention.
Figure 2:
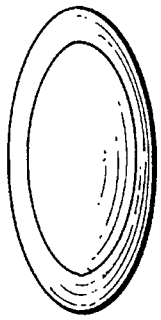
FIG. 2 is the view of FIG. 1 from the left to the right.
Figure 3:
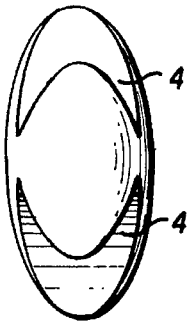
FIG. 3 is the view of FIG. 1 from the right to the left.
Figure 4:
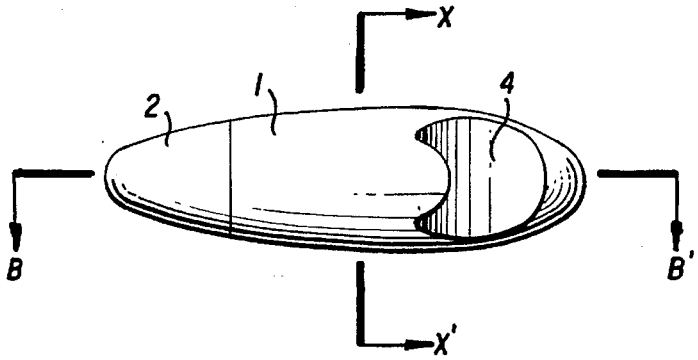
FIG. 4 is the view of FIG. 1 from the bottom to the top.
Figure 5:
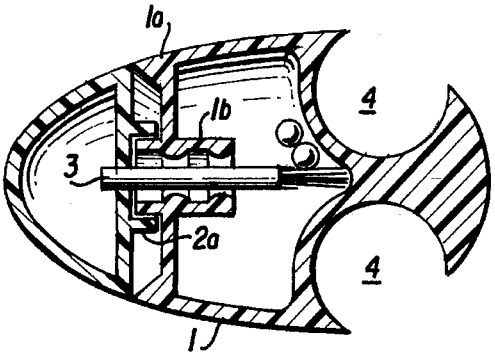
FIG. 5 is the section of FIG. 4 along the plane B—B'.
Figure 6:
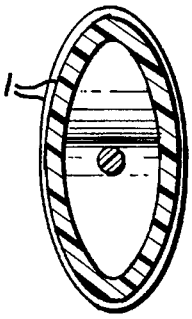
FIG. 6 is the section of FIG. 4 along the plane X—X'.
Figure 7:
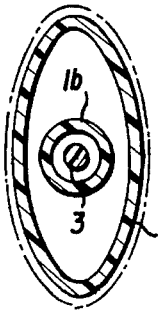
FIG. 7 is the section of FIG. 1 along the plane Y—Y'.
Figure 8:
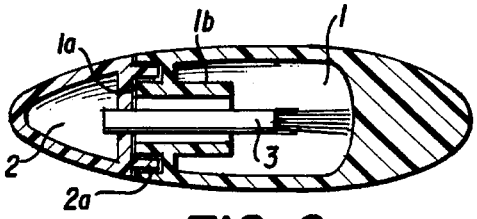
FIG. 8 is the section of FIG. 1 along the plane A—A'.

In the preferred embodiment illustrated in the annexed drawings such plug 2 has an outer shape and dimensions such as to perfectly fit those of tank 1, thus offering to the sight the aspect of a monolithic body of egg-shaped flattened profile (see FIGS. 1 and 4).

Plug 2 has an inner collar (2*a*) to which the nozzle 1*a* of tank 1 fits.

The main characteristic of tank 1 is that of including two deep recesses 4 of curved shape located near its bottom and at opposite positions with respect to the transversal symmetry plane A–A'.

Figure 9:
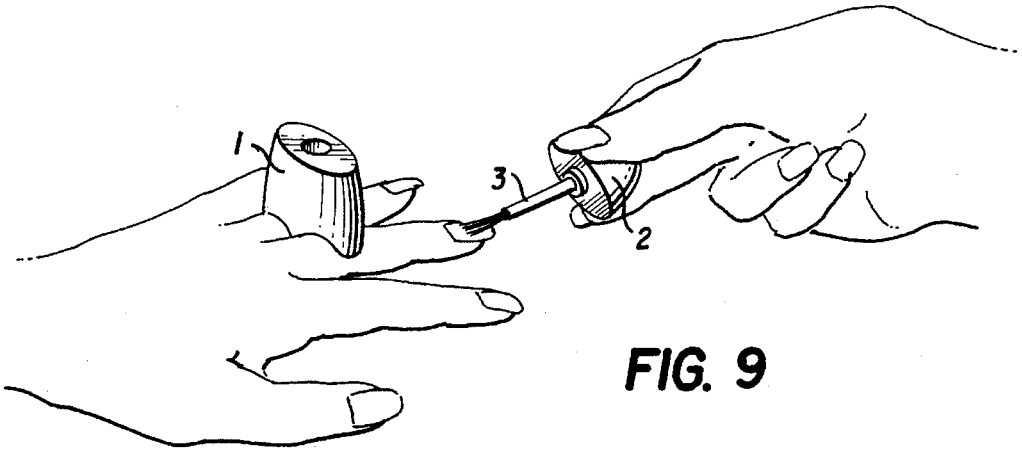
FIG. 9 shows a perspective view of how the container according to the invention may be held between two fingers of the user's hand.

As shown in FIG. 9, two adjacent fingers of the hand can be put into such recesses 4 so as to easily take hold of tank 1.

Figure 10:
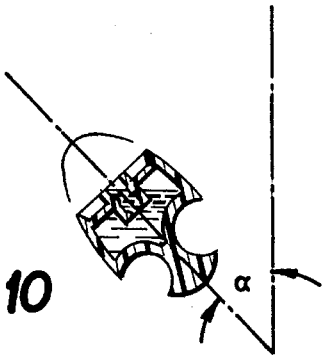
FIG. 10 shows a section of an inclined container without plug.
Figure 11:
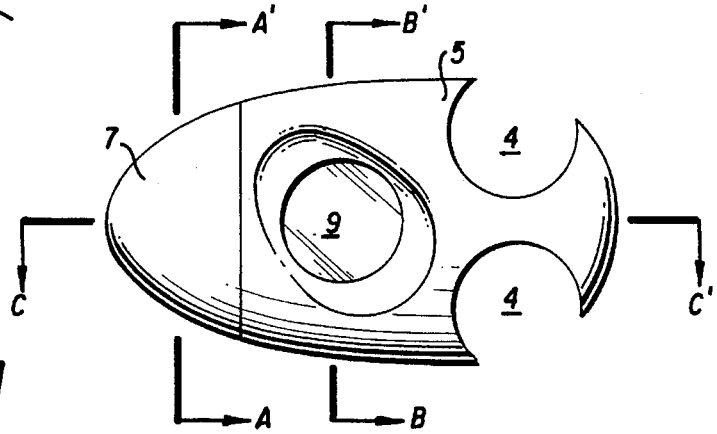
Figure 18:
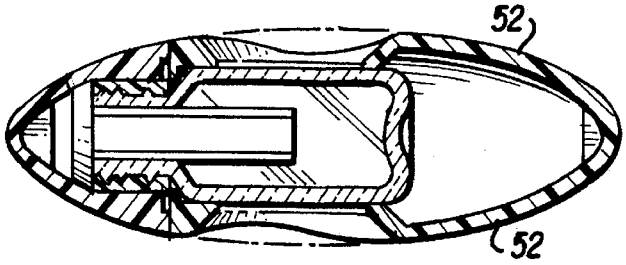
FIG. 18 shows a section of the tank of FIG. 11 along line C—C'.
Figure 19:
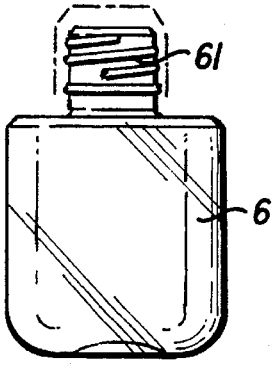
FIGS. 19 to 21 show a elevation front view, a side view and a top plan view of a bottle of nail-varnish to be used as the tank of FIG. 11, respectively.
Figure 20:
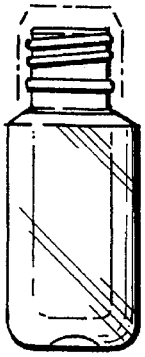
Figure 21:
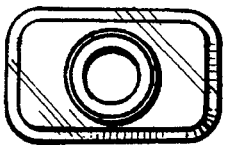
Figure 22:
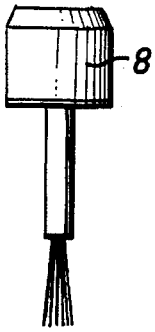
FIG. 22 shows the plug with brush of the bottle of FIGS. 19 to 21.

It should be appreciated that the outer nozzle la projects within tank 1 by a length 1*b* which prevents the nail-varnish from flowing outside in case tank 1 is sidewise inclined, provided that a limit tilting angle ($\alpha$) is not exceeded, as shown in FIG. 10.

In a second preferred embodiment, the tank consists of a body 5 preferably of plastic and made of two mirror-halves 52, within which suitable seats 51 are formed so as to house and hold a bottle 6 of nail-varnish, preferably of transparent glass. Bottle 6 is of the type commonly used for containing nail-varnish and is provided with a spout 61 to which plug 8 provided with a brush is screwed. Plug 8 rotates, being integral with a shaped lid 7 having the same form as the already described plug 2.

Each half 52 has a shaped through hole 9 allowing the colour of the nail-varnish contained in bottle 6 to be seen from the outside.

Advantageously, the two halves 52 may be, for example, permanently glued to each other or connected so as to be disassembled for replacement of the bottle.

I claim:

1. A container for nail-varnish which can be held interposed between fingers, said container comprising a tank including a reservoir for containing nail-varnish, and a plug cap closure member having an axial brush attached thereto for drawing nail-varnish from the reservoir and applying the varnish to nails, wherein the tank has two arcuate shaped recesses spaced from said plug cap closure member, each recess being dimensioned to accommodate a finger of a user's hand and being spaced from one another on opposite sides of said tank in order to keep adjacent fingers which are seated in the recesses spaced apart during the application of the nail-varnish.

2. A container according to claim 1, wherein said plug a closure member has an inner collar to which the outer nozzle of tank perfectly fits, said outer nozzle projecting into said tank a distance thus preventing nail-varnish from flowing out of the container when the container is tilted up to a maximum of container, limit tilting angle.

3. A container according to claim 1, wherein said plug a closure member has a shape and dimensions such that when assembled with the tank the container has a smooth and continuous outer surface and the appearance of a one-piece flattened generally egg-shaped configuration.

4. The container according to claim 1, wherein it is made of moulded plastic material.

5. The container according to claim 1, wherein it is made of glass.

6. The container according to claim 1, wherein said tank (1) is made of two mirror-halves which define therebetween a cavity for housing and holding a bottle of nail-varnish, and said container further includes a bottle of nail-varnish disposed within said cavity.

7. The container according to claim 1, wherein said tank comprises two mirror halves which define therebetween a cavity for holding a bottle-of nail-varnish, said mirror-halves each having a central through-hole which enables the color of the nail-varnish contained in the bottle to be seen from the outside.

8. The container according to claim 1, wherein said tank has a cavity therein, a bottle of nail-varnish is disposed within said cavity, and said bottle is made of transparent glass.

9. The container according to claim 6, wherein said halves are made by moulding a plastic material.

10. The container according to claim 6, wherein said halves are fixedly connected to each other by gluing.

11. The container according to claim 6, wherein said halves may be disassembled in order to replace the bottle.

12. The container according to claim 2, wherein it is made of moulded plastic material.

13. The container according to claim 3, wherein it is made of moulded plastic material.

14. The container according to claim 2, wherein it is made of glass.

15. The container according to claim 3, wherein it is made of glass.

16. The container according to claim 6, wherein each half has a central through hole in order that the color of the nail-varnish contained in the bottle may be seen from the outside.

17. The container according to claim 6, wherein said bottle is of transparent glass.

18. The container according to claim 7, wherein said bottle is of transparent glass.

19. The container according to claim 7 wherein said halves are made by moulding a plastic material.

20. The container accoording to claim 6 wherein said halves (52) are made by molding a plastic material.

* * * * *